US005143208A

United States Patent [19]

Shostek et al.

[11] Patent Number: 5,143,208

[45] Date of Patent: Sep. 1, 1992

[54] LEVEL SENSOR

[75] Inventors: Edward M. Shostek, Fairview; Francis J. Zelina, Lake City, both of Pa.

[73] Assignee: American Sterilizer Company, Erie, Pa.

[21] Appl. No.: 657,926

[22] Filed: Feb. 20, 1991

[51] Int. Cl.[5] ..... H01H 29/00

[52] U.S. Cl. ..... 200/187; 200/215; 200/61.47; 200/220; 33/366

[58] Field of Search ..... 200/187, 188, 189, 215, 200/216, 217, 218, 219, 61.45 R, 61.45 M, 61.47, 61.52, 220, 224; 33/366; 269/322, 323, 324, 325, 326; 5/600, 607, 608, 613, 618, 453; 254/418, 419, 423

[56] References Cited

U.S. PATENT DOCUMENTS

| | | | |
|---|---|---|---|
| 1,642,718 | 9/1927 | Bolling | 200/220 X |
| 1,695,260 | 12/1928 | Walker | 200/215 |
| 1,715,948 | 6/1929 | Reinartz | 200/187 X |
| 1,720,180 | 7/1929 | Keiser | 200/220 X |
| 1,925,274 | 9/1933 | Norviel | 200/220 X |
| 1,936,324 | 11/1933 | Carson | 200/189 X |
| 2,296,053 | 9/1942 | Porter et al. | 200/61.52 |
| 2,569,796 | 10/1951 | Browning | 33/366 X |
| 2,745,091 | 5/1956 | Leffler | 200/61.47 X |
| 3,259,202 | 7/1966 | Griffeth | 200/61.52 |
| 3,657,695 | 4/1972 | Birmingham | 33/366 X |
| 4,325,190 | 4/1982 | Duerst | 33/366 X |
| 4,678,093 | 7/1987 | Allen | 200/220 X |
| 4,743,037 | 5/1988 | Hanser | 254/423 X |
| 4,745,647 | 5/1988 | Goodwin | 5/453 |
| 4,820,888 | 4/1989 | Shields | 200/61.52 |
| 4,930,787 | 6/1990 | Nobles | 33/366 X |
| 4,942,635 | 7/1990 | Hargest et al. | 5/453 A |
| 4,954,725 | 9/1990 | Webster | 200/187 X |

FOREIGN PATENT DOCUMENTS

| | | | |
|---|---|---|---|
| 738088 | 10/1955 | United Kingdom | 200/215 |
| 793173 | 4/1958 | United Kingdom . | |
| 958732 | 5/1964 | United Kingdom | 200/187 |

*Primary Examiner*—Henry J. Recla
*Assistant Examiner*—Glenn T. Barrett
*Attorney, Agent, or Firm*—Kirkpatrick & Lockhart

[57] ABSTRACT

An apparatus for sensing the horizontal level of a table or other surface and returning that table or other surface back to level. The apparatus includes a housing within which first and second mercury switches are positioned relative to each other in a manner which permits the electrical contacts of each switch to be positioned on opposite ends of the housing. Two spring clips are provided for securing the first and second mercury switches within the housing. A pivot rod is provided to permit each mercury switch and spring clip assembly to pivot about a transverse axis within the housing. An adjusting screw and stablizing spring pair are positioned adjacent to each of the two mercury switch and spring clip assemblies. The adjusting screws may be turned to set the position of the mercury switch about the axis of the pivot rod relative to the horizontal plane in order to set a dead band wherein neither of the two mercury switches is closed. A chemical compound is used to seal the housing and prevent the switches from moving once the dead band is set. Finally, an electrical circuit which detects the activation of either of the two mercury switches is provided.

13 Claims, 3 Drawing Sheets

LEVEL SENSOR

BACKGROUND OF THE INVENTION

1. Field of the Invention

This invention relates generally to a level sensing apparatus, and more particularly to an apparatus for sensing when a table top or other surface is displaced from a horizontal position and for returning the table top or other surface back to a horizontal position.

2. Description of the Background of the Invention

The surface of a surgical table must have the capability to traverse a wide range of angles in order to meet the varied demands of today's advanced surgery. It is also common to have portions of the surgical table be set at different angles for various procedures. Concern for precision, safety, reliability, maintainability, and patient comfort place stringent demands on the ability for a surgical table to traverse the necessary angles and return that table to a level position. Because of the varied sensitivity and technology level of other surgical equipment in the operating room, any movement of the surface of the surgical table should be accomplished with a minimum amount of effort and disturbance to the remainder of the operating room.

It may be critical that the table have the ability to maintain a horizontal position under extremely tight tolerances. This is especially important, for example, when transferring a patient to or from the operating table or transporting a patient within the hospital. There are other instances which require that portions of the table be kept perfectly level, for example, during certain surgical procedures. Those and other applications impose requirements such that the level along the horizontal plane must be maintained to within plus or minus one degree. The table may move under impact or vibrations, therefore the ability to automatically return the table surface to a horizontal level may be required.

Any device which purports to keep a surgical table level must be compact and must be mountable underneath the table or along its side in order to be non-intrusive to the operating staff or the patient. Such a device must not drift or otherwise fall out of calibration once set. If electrically controlled, such a device must use only a minimal amount of energy so as to suppress any electrical noise to avoid interference with delicate surgical equipment which may be present. The ability to quickly and effectively return the surgical table to a horizontally level position is necessary. Finally, such a device must be affordable.

Mechanical cranks are sometimes used to set the angle of a surgical table. Those mechanical cranks typically can be turned to set the table at any angle and subsequently return the table to horizontal. Mechanical cranks pose several problems. There is a significant effort required on the part of the operating room personnel to adjust the level of the table if a mechanical crank is used. A mechanical crank may take up valuable space or may be inconveniently located. More importantly, mechanical cranks are often subject to drifting under strong vibrations or impacts.

Electronically controlled actuators are also available for adjusting the level of the table. A bubble in a liquid filled tube may be used to determine the level of the table relative to the horizontal plane, but is hard to calibrate to within tight tolerances as sighting a bubble is somewhat subjective. While electronically controlled actuators may be more effective than mechanical cranks in some applications, level sensing is still somewhat subjective if bubble sights are used.

Inclinometers of the type used on aircraft are available and are sometimes employed on surgical tables. For example, inclinometers are used in some cardiology units. Those inclinometers employ a capacitance detection circuit to detect when the table is displaced from the horizontal. However, such inclinometers are prohibitively expensive for general surgical applications.

Commercial tilt switches are also available for detecting the horizontal displacement of a table, but are unsuitable for purposes of level sensing a surgical table because the tolerances are typically no more sensitive than plus or minus five degrees or greater.

There is a mercury switch for an automatic cutoff device disclosed in U.S. Pat. No. 3,259,202 issued to Griffeth. The switches shown in the Griffeth patent are disposed in pairs and both switches of each pair can be displaced in opposite directions off of the horizontal to create a dead band. A dead band is defined as a range through which the switches may traverse wherein neither switch is closed. The device disclosed in the Griffeth patent is described as an automotive ignition cut-off switch, but the specification indicates it may be used as a leveling device. There are several problems with the Griffeth device which make it unsuitable for use with a surgical table or other device requiring precision maneuverability. There is only a crude adjustment means to create a dead band wherein neither mercury switch is closed. Therefore, that device could not be used in applications requiring tight tolerances. Furthermore, mercury must be handled extremely carefully, especially in a sterile environment such as an operating room. Because the unit is not encapsulated, it may lose adjustment due to routine shocks and vibrations. Lastly, the Griffeth package is large and the device shown does not appear to be mountable on a side of, or underneath, a table.

U.S. Pat. No. 2,296,053, issued to Porter, discloses a shut down device which includes a pair of switches side by side, each responsive to displacement in one direction about a transverse axis. The switches employ metal balls which, when positioned in a small opening, close an otherwise open circuit. The switches may be displaced from the horizontal to a desired angle in order to create a dead band wherein neither switch is closed. There are several problems with the apparatus of Porter which make it unsuitable. The use of metal balls is crude such that the dead band cannot be finely adjusted and therefore could not be used in tight tolerance applications. Only one end of the ball sense switch is fixed which may cause erratic operation at the large angles traversed by a surgical table. Because the unit is not encapsulated, it may lose adjustment due to routine shocks and vibrations. Lastly, the Porter package shown appears to be too large to be mounted on a side of, or underneath, a table.

Another leveling device which employs a mercury switch is disclosed in British Patent No. 793,173. An electrical contact is positioned on each side of the mercury switch allowing it to close when tilted in either direction. The mercury switch may be curved and mounted such as to create a dead band wherein neither side of the switch is closed. No means for mounting the switch or sealing the switch once mounted are suggested.

SUMMARY OF THE INVENTION

In accordance with the present invention, an apparatus for sensing the horizontal level of a table or other surface and returning that table or other surface back to level is provided. The level sensor includes a first mercury switch having a first electrical contact on one end and a second mercury switch having a second electrical contact on one end which is positioned adjacent to the first mercury switch. An electrical circuit responsive to the mercury switches is provided. Means for securing the positions of the mercury switches relative to each other and means for pivoting the mercury switches to a desired degree about a transverse axis lying within a horizontal plane adjacent to the mercury switches is provided.

The mercury switches and means for securing their positions are preferably housed in any suitable casing or container. In one embodiment of the present invention, the second electrical contact is opposite the first electrical contact relative to the transverse axis. The means for securing the first and second mercury switches is preferably in the form of a first and second clip. Each clip includes a first portion, preferably having an integrally formed male extension intermediate the ends thereof and a second portion projecting from at least a portion of a longitudinal edge of the first portion. The second portion of each clip is configured to cradle a mercury switch. The means for pivoting the mercury switches may include a pivot rod extending through bores in the male extensions of each clip's first portion in axial alignment with the transverse axis and a means for adjusting the positions of the mercury switches about the pivot rod. The means for adjusting the position of the mercury switches is preferably provided by an adjusting screw and stabilizing spring pair in contact with each of the two mercury switch and spring clip assemblies. The adjusting screws may be turned to set the position of each mercury switch about its pivot axis relative to the horizontal plane in order to set a dead band wherein neither of the two mercury switches is closed. A potting compound which fills the housing is used to surround and encapsulate the switches in the clips.

Accordingly, the present invention provides solutions to the aforementioned problems present in sensing the horizontal level of a table and correcting the same. As this invention provides a compact, easily mountable electrical level sensor, the problems caused by bulky switches and mechanical cranks are alleviated. The problems of adjusting the dead band to meet tight tolerances are alleviated as the present invention provides an easy, flexible method of adjusting the dead band. The invention provides the ability to seal the level sensor housing after calibration, thereby overcoming the problems of safety and reliability found in many conventional devices. Furthermore, the present invention provides a device which will not drift or fall out of calibration once set. Since the mercury switches of the present invention are normally open, the electrical current used and corresponding electrical noise are kept to a minimum. Finally, this invention provides a device which is affordable so as to be effective on a wide variety of applications. These and other details, objects, and advantages of the invention will become apparent as the following description of the present preferred embodiment thereof proceeds.

BRIEF DESCRIPTION OF THE DRAWINGS

For the present invention to be clearly understood and readily practiced, a preferred embodiment will now be described, by way of example only, wherein.

DETAILED DESCRIPTION OF THE PREFERRED EMBODIMENTS

Figure 1:
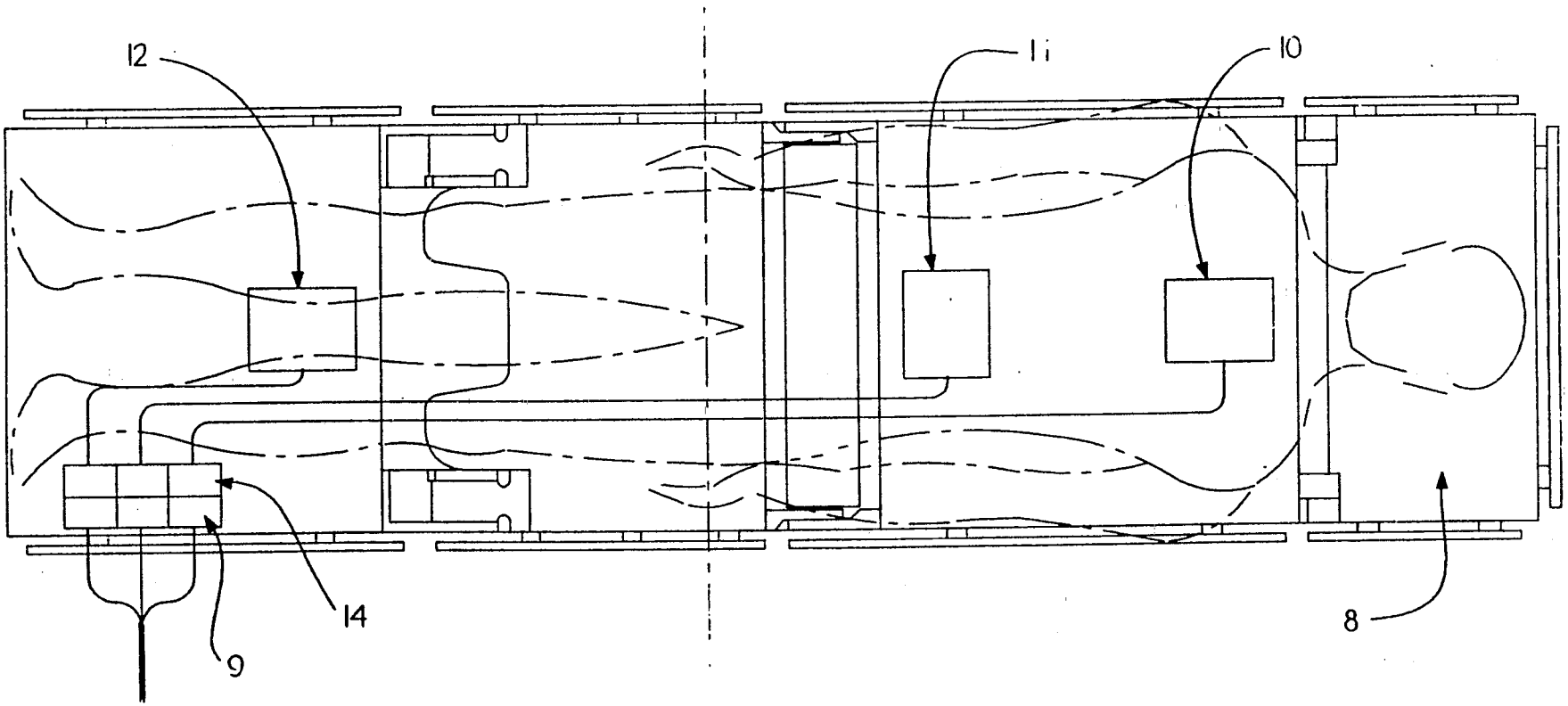
FIG. 1 is a top view of a surgical table upon which multiple level sensors are mounted.

Referring to FIG. 1, there is shown a level sensor 10 which can be mounted on a surgical table 8. While the present invention will be described in the context of a surgical table, this is not intended to exclude other possible applications where electronic level sensing can be used. More particularly and with reference to FIG. 1, there is shown, by way of example, multiple level sensors 10, 11, and 12 positioned on the underside of a surgical table 8. One level sensor 10 may be used for sensing the level under the back of the patient along a longitudinal axis of the table, a second level sensor 11 may be used for sensing the level under the back of the patient along a transverse axis of the table, and a third level sensor 12 may be used for sensing the level under the legs of the patient along a longitudinal axis. Each of the level sensors 10, 11 and 12 has a pluggable connector 14 which can be attached to a mating connector 9 in order to electrically connect each level sensor 10, 11, 12 to a microprocessor based electrical circuit (not shown). It should be understood that various numbers and configurations of level sensors 10, 11, 12 may be employed to meet the requirements of a particular application.

Figure 2:
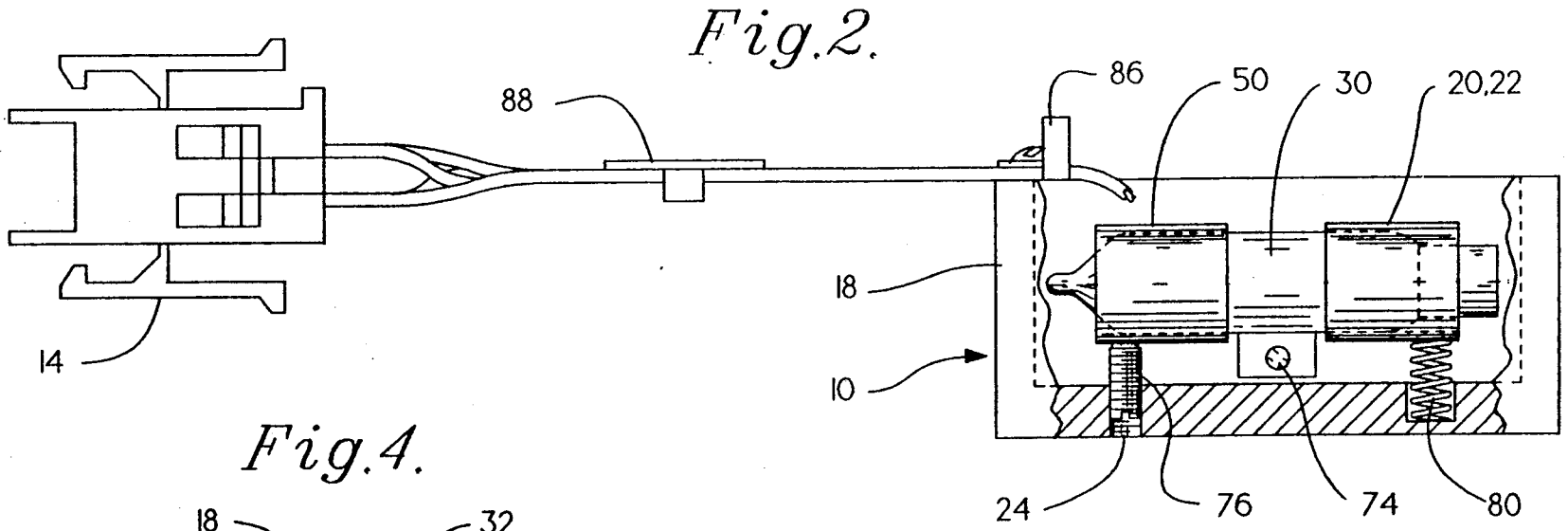
FIG. 2 is a side elevation view of a level sensor apparatus showing a cutaway of the housing, electrical wires, and a pluggable connector.
Figure 5:
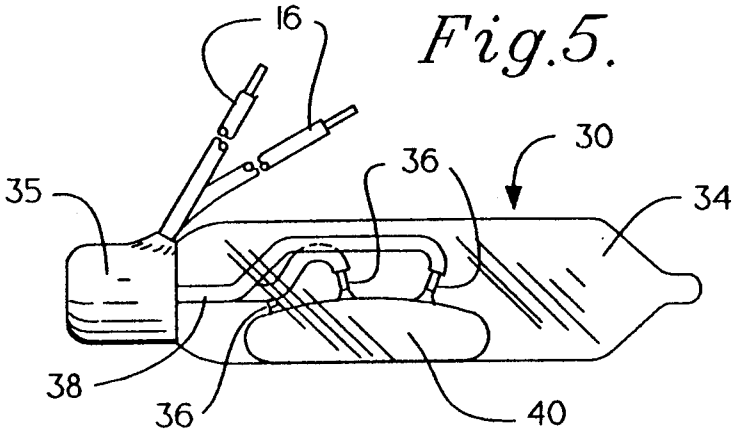
FIG. 5 is a side elevation view of a mercury switch.
Figure 4:
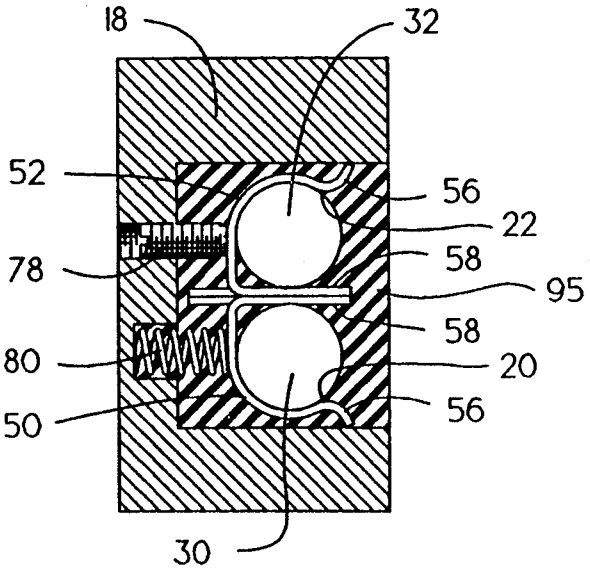
FIG. 4 is a cut away view along the line A—A in FIG. 3 showing two mercury switches, clips, and an adjusting screw and stabilizing spring positioned within the housing.

FIG. 2 shows one level sensor 10 comprising a housing 18, a pluggable connector 14, and electrical wires 16. Two identical mercury switch and clip assemblies 20, 22 as herein described are positioned within the housing. Mercury switches are known in the art and may be purchased commercially. For example, one such mercury switch is manufactured by Micro Switch, Inc. As shown in FIG. 5, a mercury switch 30 has a glass enclosure 34 containing three electrical contacts 36. The electrical contacts 36 are electrically connected with leads 38 which in turn are electrically connected with electrical wires 16. A mercury bubble 40 is positioned within the glass enclosure 34 such that gravitational forces may cause the mercury bubble 40 to move along the inside of the glass enclosure 34. A cap 35 seals the mercury bubble 40 within the glass enclosure 34 while a bore (not shown) in the cap 35 provides a means through which the leads 38 may pass. The size of the mercury bubble 40 is such that it may electrically connect the electrical contacts 36 when properly positioned within the glass enclosure 34. When the electrical contacts 36 are electrically connected to the leads 38, the mercury switch 30 is considered to be closed. When the electrical contacts 36 are not electrically connected to the leads, the mercury switch 30 is considered to be open.

Figure 6:
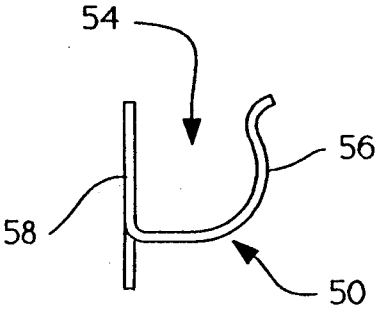
FIG. 6 is an end elevation view of a clip used to secure a mercury switch within the level sensor housing.

The first mercury switch 30 is positioned within a first spring clip 50. This spring clip 50, shown in FIG. 6, provides a generally U-shaped opening 54 within which the mercury switch is placed. One resilient second portion, or leg 56 of the clip 50 may be urged in a direction away from the first portion or side 58 of the clip 50 to temporarily widen the opening 54 for insertion of the first mercury switch 30. The resilient leg 56 returns to its original position to securely cradle the mercury switch 30 in position. Leg 56 is curved to act in a resilient manner and to apply tension to the switch 30 to maintain its position. The clip 50 may be made of a metal alloy, or any other suitable material which has flexible spring characteristics.

Figure 8:
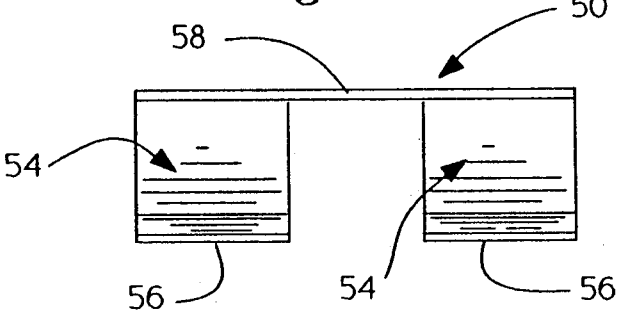
FIG. 8 is a top plan view of the clip shown in FIG. 6.
Figure 7:
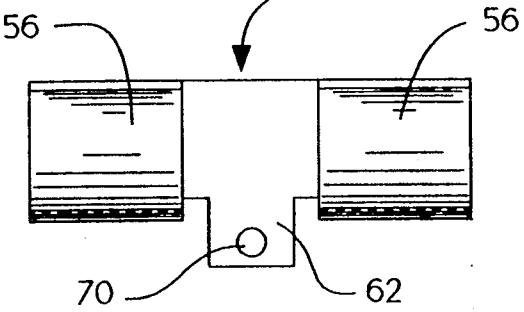
FIG. 7 is a side elevation view of a side of the clip of FIG. 6.

Referring to FIG. 7, the clip 50 is designed such that on the side 58, there is a male extension 62 intermediate the ends thereof. There is a bore 70 through the male extension 62 along the transverse axis. The leg 56 of the clip 50 has no corresponding male extension as shown in FIGS. 6 and 8. A pivot rod 74 may be passed through the bore 70 and connected to the housing 18 such that the entire clip may pivot about the transverse axis.

Referring again to FIG. 2, the clip 50 and first mercury switch 30 form an assembly 20 which is positioned within the level sensor housing 18. Initially, the position of the assembly 20 is such that the first mercury switch 30 is level in the horizontal plane. A first adjusting screw 76 is placed through a bore 24 in the housing positioned perpendicular to one end of the clip 50. A first stabilizing spring 80 is positioned within the housing 18 perpendicular to the opposite end of the clip 50 relative to the pivot rod 74 and the adjusting screw 76. The adjusting screw 76 and stabilizing spring 80 are arranged such that when the adjusting screw 76 is tightened (turned clockwise on a right hand threaded screw), the corresponding stabilizing spring 80 is compressed. Likewise, when the adjusting screw 76 is loosened (turned counterclockwise on a right hand threaded screw), the corresponding stabilizing spring 80 expands. The first mercury switch 30 is tilted a corresponding amount. While the spring 80 in the figures is shown as being near the cap 35 of mercury switch 30, it can be positioned at either end with the screw 76 positioned on an opposing end.

Figure 3:
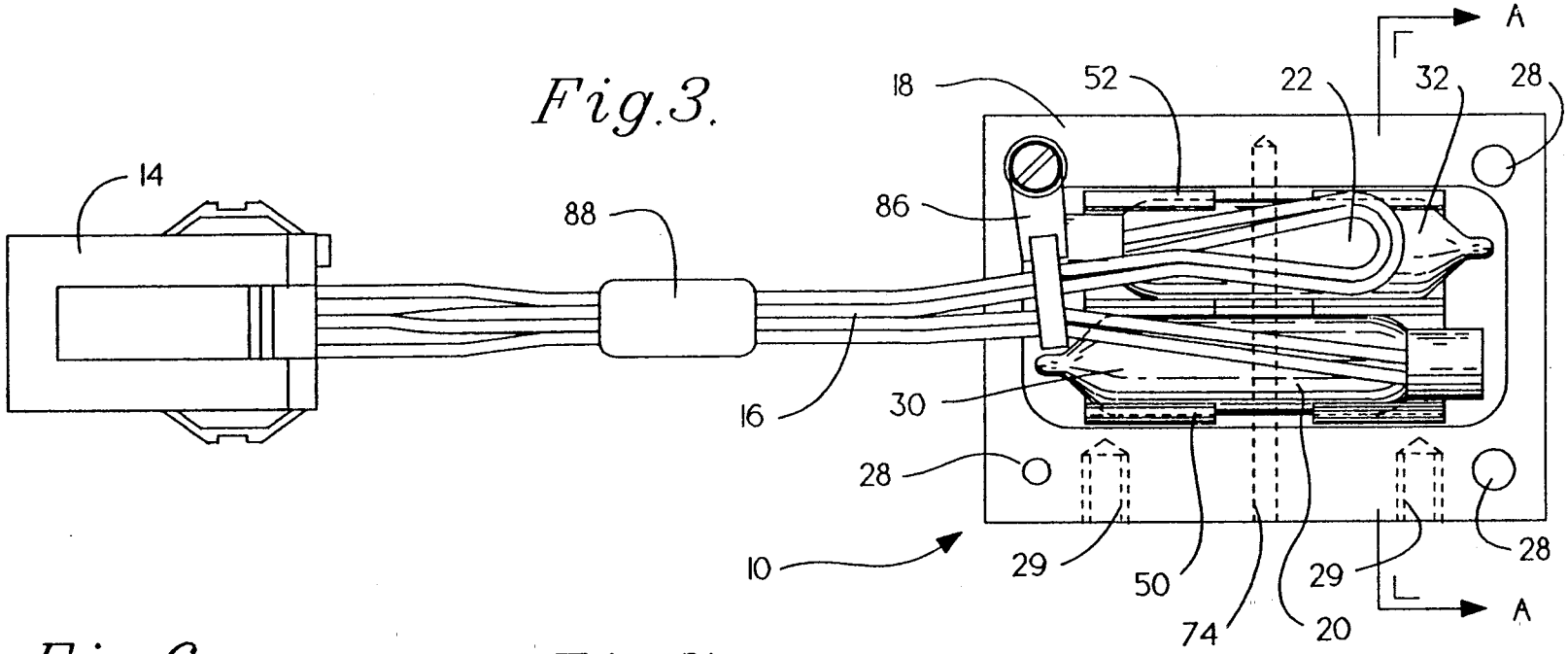
FIG. 3 is a top view of the level sensor apparatus shown in FIG. 2.

The above description pertains to a first mercury switch 30 and first clip 50. It should be noted that in a similar manner, a second mercury switch 32 and a second clip 52 are combined to make a second switch and clip assembly 22. The second assembly 22 is positioned in the housing 18 in a similar fashion and adjacent but rotated 180 relative to the first assembly 20. Thus, the end of the second mercury switch 32 containing the electrical contacts 34 is on the opposite longitudinal end of the housing as can be seen in FIG. 3. There is a second adjusting screw 78 and second stabilizing spring (not shown) pair arranged similarly to the first pair such that when the second adjusting screw 78 is tightened the corresponding stabilizing spring is compressed and when the adjusting screw 78 is loosened, the corresponding stabilizing spring expands. The mercury switch 32 is thus tilted a corresponding amount.

Once the two mercury switches 30, 32 are positioned within the housing 18, the dead band may be set. A dead band is defined as an area where neither of the two mercury switches 30, 32 are closed. This dead band can be set at any desired angle, for example, within a range of about plus or minus one degree, including angles less than one degree for some applications. The dead band is set by turning the first adjusting screw 76 and the second adjusting screw 78 a desired amount such that the corresponding ends of the first mercury switch 30 and the second mercury switch 32 containing the electrical contacts 36 are raised above the horizontal plane about the pivot pin 74. This causes the mercury bubble 40 to flow away from the contacts 36 when the housing 18 is horizontal, leaving the mercury switches 30, 32 open.

Once the dead band is set and calibrated, the position of the first and second adjusting screws 76, 78, the first and second stabilizing springs 80 and first and second mercury switch and clip assemblies 20, 22 may be set permanently. This is done by filling the housing 18 with a potting compound 95. The potting compound used must have certain chemical properties, specifically the shrink rate and hardness, to ensure effective sealing and so as to not damage the glass enclosure 34 of either mercury switch 30, 32. One such compound, for example, is a commercially available silicon rubber, such as RTV potting compound 95. It is mixed in two parts then immediately poured due to its quick setting action. Other comparable setting compounds may be used. After filling the housing 18 with the compound 95, the compound 95 should be allowed to set. The potting compound 95 also adds a measure of safety to the level sensor 10. If the glass mercury switches 30, 32 break, the potting compound 95 will prevent the mercury from spilling out.

Mounting holes 28 may be provided in the housing 18 for mounting the level sensor 10 on the underside of a table 8 or other surface. Side mounting holes 29 are also provided. Electrical wires 16 attached to the leads 38 of the mercury switch 30 are connected to a pluggable connector 14. For ease of installation, the electrical wires may have a wire tie 86 and label 88 as shown in FIG. 3. The pluggable connector 14 is intended to plug into a microprocessor based electrical circuit (not shown) through a mating connector 9.

Once connected to that circuit, the mercury switches 30, 32 in the level sensor 10 act as limit switches which are normally open. If the table 8 or other surface is tilted, the mercury bubble 40 in the glass enclosure 34 will slide in the direction of the gravitational forces. If the angle of the table 8 is sufficiently above or below the horizontal plane, the mercury bubble 40 in one of the mercury switches 30, 32 will contact one of the electrical contacts 36, thus closing that switch. The 180° relative orientation of the electrical contacts 36 on adjacent mercury switches 30, 32 provides an indication of a tilt above or below level. The resultant electrical signal indicating that the surface is off level will be passed back to the microprocessor based circuit for appropriate action. When appropriately activated, the microprocessor could, for example, actuate the table's movement arms to level the table in any suitable manner. Once the table is returned to the horizontal plane, the mercury bubble 40 will move such as to no longer be contacting the electrical contacts 36, opening that switch. The microprocessor will sense this open and do nothing more until one of the switches is again closed.

While the details of the level sensor 10 have been described herein for one level sensor 10, it will be understood that multiple, identical level sensors may be used for some applications. For example, as shown in FIG. 1, level sensors 11, 12 may be used along with the level sensor 10 for a surgical table 8 application. In that case, a level sensor 10 may be positioned longitudinally under the surgical table 8 corresponding to the patient's back. If the patient's back is raised, the mercury bubble 40 will move to close one of the two mercury switches 30, 32 in that level sensor 10, thereby signalling to the electrical circuit that the back portion of the table 8 has been displaced from the horizontal plane. Similarly, a level sensor 12 may be positioned longitudinally under the table 8 corresponding to the patient's legs. If the patient's legs are moved above or below the horizontal plane, one of the two mercury switches 30, 32 in that level sensor 12 will close, thereby signalling to the electrical circuit that the portion of the table 8 has been displaced from the horizontal. A third level sensor 11 may be placed along a transverse axis under the patient's back. In a similar manner, that level sensor 11 will detect when the table has been displaced from that horizontal plane. Since typically a surgical table 8 will tilt transversely in only one direction at a time, only one level sensor 11 along that axis is required. As the three level sensors 10, 11, 12 provide only a signal to the microprocessor based electrical circuit indicating one or more parts of the table 8 are off level, the closing of individual switches may or may not have an effect on the leveling of the table 8. Only under control of an operator or other surgical personnel will the microprocessor automatically respond to electrical signals from the level sensors 10, 11, 12.

It will be understood that various changes in the details of the apparatus which have been herein described and illustrated in order to explain the present invention may be made by those skilled in the art which will fall within the principle and scope of the invention as expressed herein an defined in the claims.

What is claimed is:

1. A level sensor comprising:

a first mercury switch having opposed ends and a first electrical contact located at one end;

a second mercury switch having opposite ends and a second electrical contact located at one end wherein said second mercury switch is positioned adjacent to said first mercury switch;

an electrical circuit operatively connected to said first and second mercury switches and being responsive to said first and said second mercury switches;

means for securing the positions of said first and second mercury switches relative to each other; and means for independently pivotally adjusting each of said first and second mercury switches to a desired degree about a transverse axis lying in a horizontal plane adjacent to said first and second mercury switches wherein said transverse axis lies intermediate the ends of said first and second mercury switches.

2. The apparatus of claim 1 wherein said second electrical contact is positioned opposite said first electrical contact relative to said transverse axis.

3. The apparatus of claim 1 further comprising a housing for holding said first and second mercury switches and said securing means.

4. The apparatus of claim 1 wherein said means for securing comprises:

a first clip for holding said first mercury switch;

a second clip for holding said second mercury switch, said second slip being positioned adjacent to said first clip;

and means for sealing said first and second mercury switches at said desired degree within said first and second clips, respectively.

5. The apparatus of claim 4 wherein said means for sealing comprises a potting compound wherein said potting compound surrounds said first and second clips thereby encapsulating said first and second mercury switches therein.

6. The apparatus of claim 4 wherein said first and second clips each have a bore therethrough in axial alignment with said transverse axis and wherein said means for pivoting comprises a pivot rod passing through each said bore along said transverse axis and means for adjusting the position of said first and second mercury switches about said transverse axis.

7. The apparatus of claim 6 wherein said means for adjusting comprises:

a first adjustment screw in contact with said first mercury switch on one side of said transverse axis;

a first stabilizing spring in contact with said first mercury switch on an opposite side of said transverse axis;

a second adjustment screw in contact with one end of said second mercury switch on said opposite side of said transverse axis; and a second stabilizing spring in contact with said second mercury switch on said one side of said transverse axis.

8. The apparatus of claim 7 further comprising a housing having a first bore positioned below and adjacent to said first mercury switch for receiving said first adjustment screw and a second bore positioned below and adjacent to said second mercury switch for receiving said second adjustment screw.

9. The apparatus of claim 6 wherein said means for adjusting comprises:

a first adjustment screw in contact with said first mercury switch on one side of said transverse axis;

a first stabilizing spring in contact with said first mercury switch on an opposite side of said transverse axis;

a second adjustment screw in contact with said second mercury switch on said one side of said transverse axis; and a second stabilizing spring in contact with said second mercury switch on said opposite side of said transverse axis.

10. The apparatus of claim 9 further comprising a housing having a first bore positioned below and adjacent to said first mercury switch for receiving said first adjustment screw and a second bore positioned below and adjacent to said second mercury switch for receiving said second adjustment screw.

11. The apparatus of claim 4 wherein said first and second clips each comprise:

a first portion having opposing ends, a longitudinal edge and an integrally formed male extension intermediate said ends, said male extension having a bore therethrough; and a second portion extending from at least a portion of said longitudinal edge of said first portion and being configured to cradle said mercury switch.

12. The apparatus of claim 11 wherein said first portion of said first clip is positioned in a confronting relationship relative to said first portion of said second clip.

13. The apparatus of claim 1 wherein said desired degree is within a range of about plus or minus one degree.

* * * * *

UNITED STATES PATENT AND TRADEMARK OFFICE

CERTIFICATE OF CORRECTION

PATENT NO. : 5,143,208

DATED : September 1, 1992

INVENTOR(S) : Edward M. Shostek and Francis J. Zelina

It is certified that error appears in the above-identified patent and that said Letters Patent is hereby corrected as shown below:

Col. 8, line 2, delete "slip" and substitute --clip-- therefore.

Signed and Sealed this

Twelfth Day of October, 1993

Bruce Lehman

*Attest:*

BRUCE LEHMAN

*Attesting Officer*

*Commissioner of Patents and Trademarks*